United States Patent [19]

Tolosa et al.

[11] 4,002,009

[45] Jan. 11, 1977

[54] COMBINATION TAPE DISPENSER AND TRAY SEALER DEVICE

[75] Inventors: Felix P. Tolosa; Lawrence Boxer, both of Alexandria, Va.

[73] Assignee: Dynatech Laboratories, Incorporated, Alexandria, Va.

[22] Filed: Aug. 21, 1975

[21] Appl. No.: 606,454

[52] U.S. Cl. ..... 53/296; 53/329; 53/390; 156/522; 156/543; 156/556; 156/579

[51] Int. Cl.[2] ..... B65B 7/16; B65B 61/06

[58] Field of Search ..... 53/44, 137, 129, 296, 53/297, 298, 329, 371, 373, 390, 14; 156/522, 543, 556, 579

[56] References Cited

UNITED STATES PATENTS

| | | | |
|---|---|---|---|
| 2,818,908 | 1/1958 | Byrnes et al. | 156/522 |
| 3,029,569 | 4/1962 | Taylor | 53/129 X |
| 3,658,628 | 4/1972 | Zenter | 156/579 X |
| 3,753,837 | 8/1973 | Lense | 53/329 X |
| 3,851,445 | 12/1974 | Schuh | 53/329 |

*Primary Examiner*—Travis S. McGehee
*Assistant Examiner*—Horace M. Culver
*Attorney, Agent, or Firm*—Strauch, Nolan, Neale, Nies & Kurz

[57] ABSTRACT

A device for applying a section of pressure sensitive tape as a cover over the surface of a test tray having a multiplicity of upwardly open wells comprises a base having a sealing zone intermediate a tray loading zone and a tray removal zone. The tray is placed on a slide guide at the loading zone and moved to the sealing zone where a rotatable resiliently surfaced feed roller presses the leading end of the tape upon and along the top surface of the tray while moving the tray through the device.

7 Claims, 6 Drawing Figures

FIG. 1
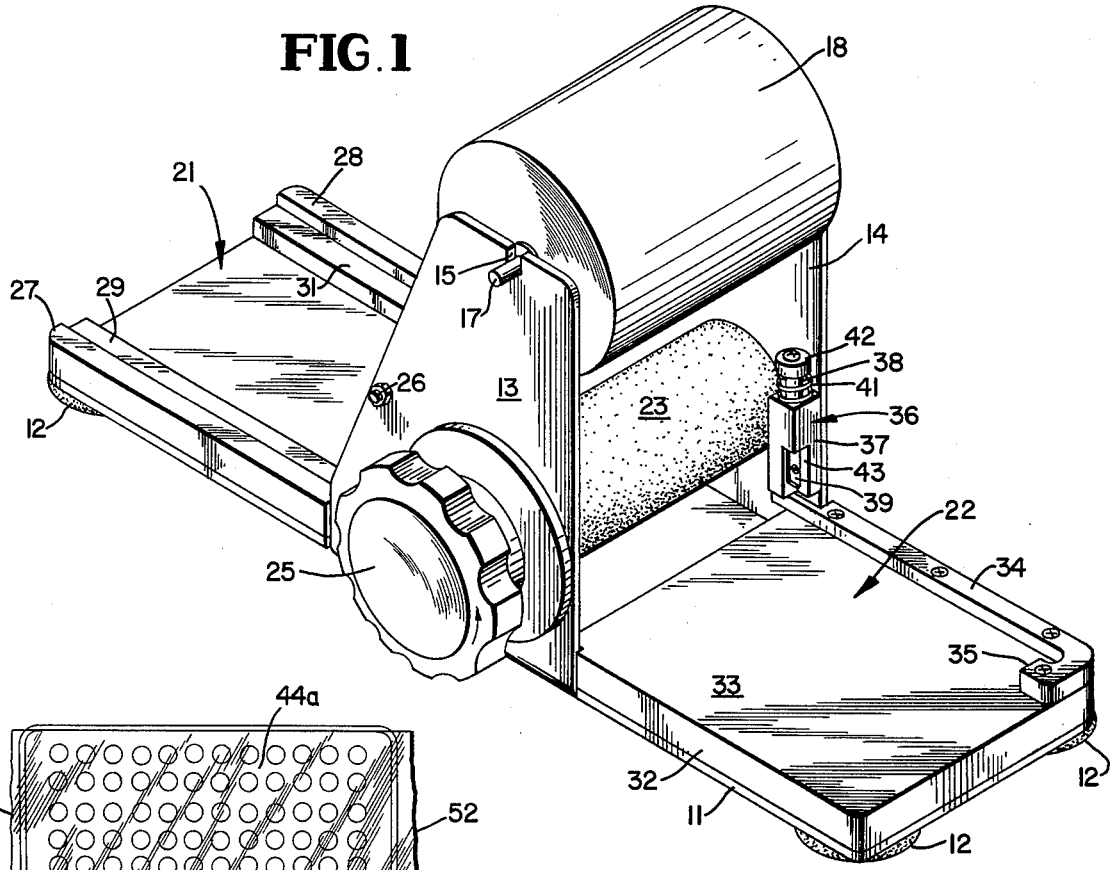
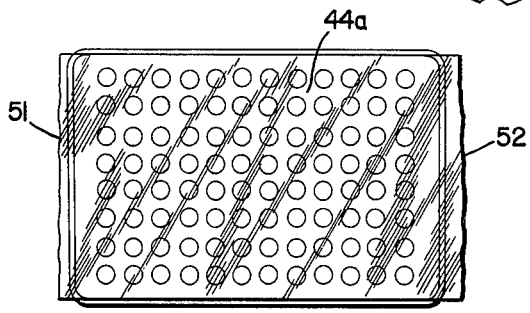
FIG. 1a
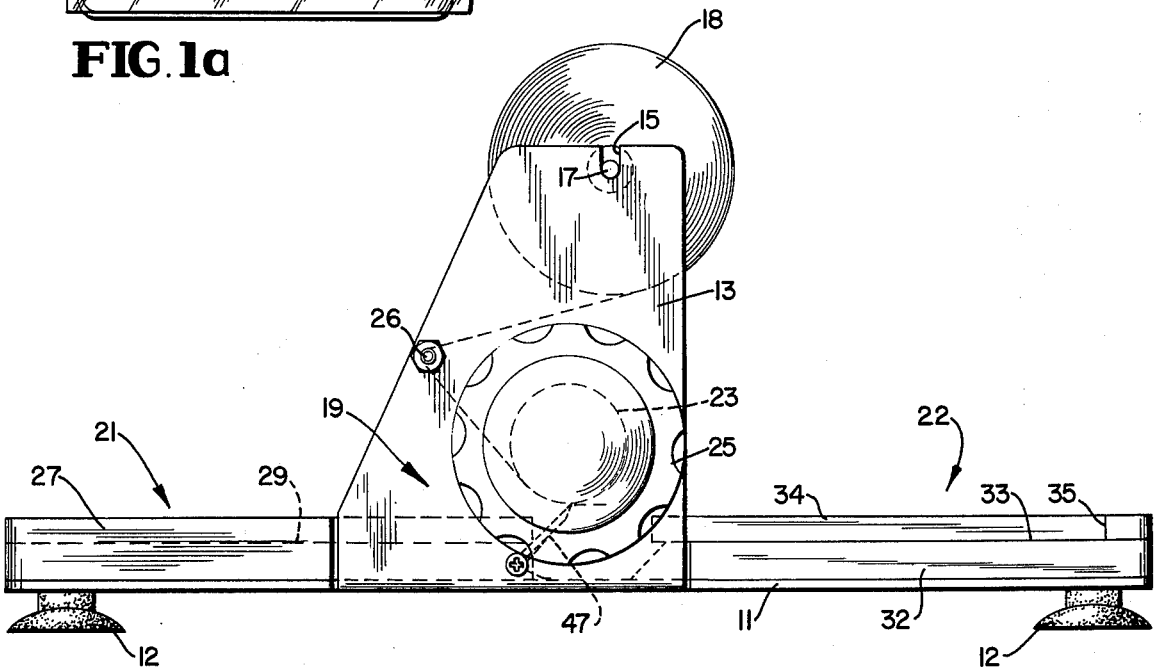
FIG. 2

COMBINATION TAPE DISPENSER AND TRAY SEALER DEVICE

This invention relates to a device for applying a sealing cover over the wells of a multiwell test tray, and particularly to such a device wherein the leading end of a tape supply is simultaneously advanced and smoothly pressed onto the tray surface surrounding the wells.

In its preferred embodiment the invention will be disclosed as incorporated in a device for applying a transparent sealing cover over the open tops of wells in a disposable plastic test tray of the type disclosed in U.S. Pat. Nos. 3,568,735 and 3,650,306. These trays are lightweight integral molded plastic disposable units having many upwardly open small wells or cells of the same size into which are dispensed measured microquantities of test or reaction liquid.

Since the trays are relatively shallow and lightweight, a transportation problem immediately presents itself once the wells receive the dispensed charges. The tray for example must be transported to a reader or storage or to a treatment device without losing any of the contents of any well and usually so as to avoid undue shaking.

Conventionally a sealing cover is applied to the tray by means of pressure sensitive tape extending over the top surface, and some makeshift devices have been proposed for holding the tray while applying the tape, but none have been wholly satisfactory.

The present invention solves the problem by providing a device wherein the tray is relatively rapidy moved smoothly in substantially a straight continuous path while sealing tape drawn smoothy from a supply is applied over its top surface, with a mimimum of jar or other force that might shake it or spill liquid from the wells, and this is a major object of the invention.

Another object of the invention is to provide a novel combination tray sealer and tape dispensing device wherein the leading end of a supply such as a roll of tape, which is preferably pressure sensitive, is smoothly gradually applied along the top surface of a guided slidably moving tray.

A further object of the invention is to provide a novel tray sealing and tape dispensing device wherein a tray is slidably displaced and pressure sensitive tape applied to its top surface by a feed roller that presses the leading end of the tape onto the tray surface and is rotated to draw the feed tape from a supply while pressing the tape smoothly onto and along the tray surface and exerting force through the tape being applied to feed the tray through a sealing zone.

A further detailed object of the invention includes a novel spring biased blade arrangement for normally holding the leading end of the tape against the feed roller when there is no tray in the device, and which is automatically moved to inactive position by tray movement into the sealing zone.

Another detailed object of the invention is the provision of a special tray removal zone structure wherein after the tray surface has been covered with tape the tape edge is slit at the trailing end of the tray so that angular displacement of the tray during removal will readily tear the covered tray free from the tape.

Further novel features and other objects of this invention will become apparent from the following detailed description, discussion and the appended claims taken in conjunction with the accompanying drawings.

BRIEF DESCRIPTION OF DRAWINGS

FIG. 1 is a generally perspective view showing a tray sealing device according to a preferred embodiment of the invention;

FIG. 1*a* is a top plan view showing the sealed tray as it is removed from the device;

FIG. 2 is a side elevation of the device;

PREFERRED EMBODIMENTS

Figure 3:
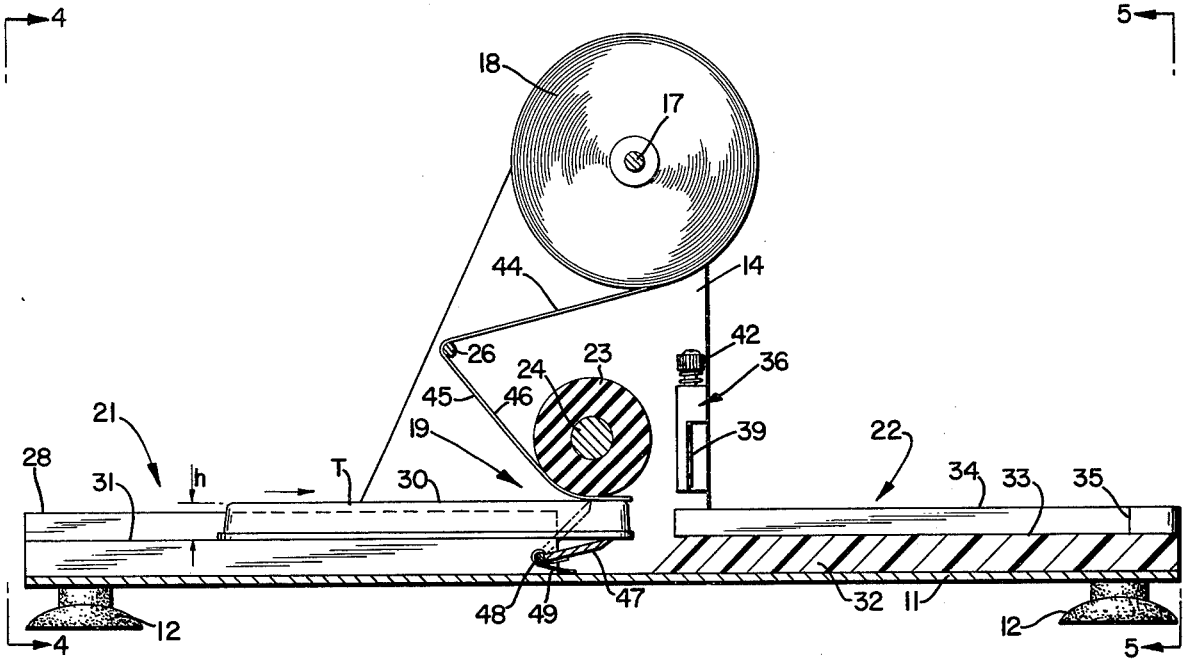
FIG. 3 is a section substantially on a longitudinal centerline of FIG. 2.
Figure 4:
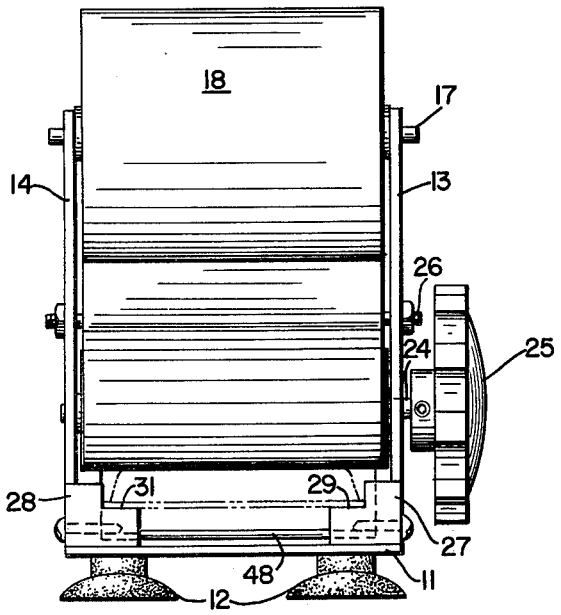
FIG. 4 is an end view looking in the direction 4-4 of FIG. 3.
Figure 5:
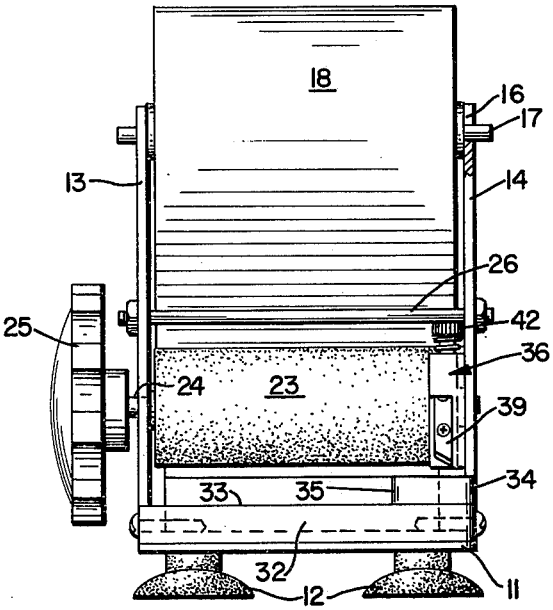
FIG. 5 is an opposite end view.

The device comprises a flat rectangular base 11 provided at the bottoms of the corners with suction cup or like non-slip fittings 12 whereby it may be fixedly disposed for use on any generally horizontal supporting surface including glass, ceramic and like smooth surfaces encountered in laboratories and hospitals.

At about midway between the ends of the base similar upstanding parallel plates 13 and 14 have their lower ends rigidly connected to base 11 and are provided at their upper ends with upwardly open recesses 15 and 16 respectively for freely rotatably receiving and mounting the arbor 17 of a roll 18 of sealing tape. Plates 13 and 14 may be upturned integral extensions of base 11.

Plates 13 and 14 effectively define a tray sealing zone 19 intermediate a tray loading 21 and a tray removal zone 22.

Below the tape roll, a uniform diameter cylindrical tape feed and presser roller 23 is rotatably mounted, having the ends of a core shaft 24 carried by journals in plates 13 and 14. The axis of roller 23 is fixed and substantially parallel to that of roll 18, and it is accurately located as will appear. The surface of roller 23 is preferably resilient and capable of non-slip engagement with the smooth tape surface as will also appear, and a synthetic rubber covering is preferred. A knob 25 is secured to one end of shaft 24 for manual rotation of roller 23.

A cylindrical tape guide roller or pin 26 extends between plates 13 and 14 above the level of roller 23. The axis of roller or pin 26 is parallel to that of roller 23, and the roller or pin 26 is located adjacent the loading zone side of the sealing zone. The tape passes smoothly under tension over pin or roller 26 which effectively prevents or smooths wrinkles in the tape. The location of pin 26 relative to roller 23 is also important in that it controls the angle that the tape approaches the roller in the assembly. Preferably the stretch of tape between pin or roller 26 and the underside of roller 23 is at an angle of about 45° or less with the horizontal.

At the loading zone parallel side guide rails 27 and 28 are fixed on the base 11 and, see FIG. 2, they extend to a point beneath the presser roller 23. These guide rails are adapted to slidably receive a tray T which for example may be of the multiwell type that has been filled in the dispensing apparatus disclosed in Lancaster U.S. Pat. No. 3,650,306, and shown in FIG. 1*a*. This tray (FIG. 3) has flat bottom surfaces adapted to rest on the coplanar horizontal surfaces 29 and 31 respectively of rails 27 and 28. The tray has a flat top surface 30 parallel to the bottom surface, and the liquid containing wells open through the top surface. The tray is therefore of uniform height indicated at *h* in FIG. 3.

At the removal zone 22 the base has secured thereto a platform 32 having a horizontal top surface 33 that is preferably exactly coplanar with the surfaces 29 and 31 of the loading zone. A side guide rail 34 is fixed to extend along one side edge of surface 33, and it terminates in a tray end abutment 35 at the rear edge of surface 33.

A cutter assembly 36 is mounted on the inner side of plate 14 above the front edge of surface 33 as shown in FIGS. 1 and 3. This assembly comprises a support block 37 secured to plate 14 and having a vertical bore slidably receiving the stem 38 of a knife blade 39. A spring 41 reacting between block 37 and a button 42 on stem 38 resiliently biases the knife blade to a normally inactive position within the recess 43 just above the level of the tray being sealed.

In use the device is placed on a horizontal surface where it is anchored by fitting 12. A filled tray T containing the dispensed liquid or liquids is placed on rails 27, 28 and slidably moved toward the sealing zone. Referring to FIG. 3, the leading end of the sealing tape 44 from roll 17 is passed over roller or pin 26 and then under roller 23. Tape 44 is preferably of the pressure sensitive type with one sticky surface 45 that (FIG. 3) faces down toward the tray and an upper smooth nonsticky surface 46 passing under the roller 23.

When there is no tray being sealed, tape 44 is held in engagement with the bottom of roller 23 by a retainer blade 47 disposed mainly in the space between the end of guides 27, 28 and the platform 32. Blade 47 extends the width of the tape and is pivoted on a fixed transverse axis 48 at the base parallel to the axis of roller 23 and is resiliently biased upwardly as by spring 49 to the dotted line position of FIG. 3 where it holds the tape 44 in contact with the lower side of roller 23.

The end of tape 44 passing under roller 23 is disposed substantially in a horizontal plane tangent to the periphery of roller 23, and that plane is spaced from the plane containing ledge surfaces 29 and 31 by a distance that is preferably equal to or slightly less than the height *h* of the tray T.

Thus in the beginning the operator slides tray T along the guide rails 27, 28 until it reaches the position shown in FIG. 3. At this point the tray has engaged and rocked retainer blade 47 down to the inactive full line position of FIG. 3 and while tension is retained in the tape the leading edge of the sticky undersurface 45 of the tape has been pressed onto one edge of the top surface 30 of the tray. At this point the leading end of the tray is essentially gripped tightly between the guide rails and roller 23.

Now the operator manually turns knob 25 counter clockwise in FIGS. 1 and 3, and this simultaneously feeds the tray in continued straight line motion to the right in FIG. 3, pulls tape 44 off the idling roll 18 and applies pressure to smoothly secure tape 44 upon and along upper surface 30 of the tray. Since the width of the tape is the same as that of the tray, coverage of all of the wells is attained.

During advance of the tray by roller 23, the resilient deformable surface of roller 23 adapts to accept small tolerances in the shape and height of the tray while exerting gripping and driving pressure through the tape. The gap between the ends of the guide rails and the edge of the platform is small so that most of the time the tray is fully supported below. The feeding movement of the tray is very smooth and continuous so that none of the contents of the wells are lost or even undesirably shaken, and the leading end of the tray soon glides over platform surface 33 until it abuts the member 35.

The length of the platform is such that the trailing edge of the tray is located substantially under and usually a small distance past the knife blade 39 when the tray movement is arrested by abutment 35. By the time the tray is arrested its trailing edge has moved past retainer blade 47 which snaps back up to again trap the leading end of the tape against the underside of roller 23 and maintain tension in the tape.

Now the operator places his finger on button 42 to depress knife blade 39 to cut a slit in the edge of tape 44 beneath it. Referring to FIG. 1, there being no side guide on one side of the platform, the operator takes the tray off the platform with a combined sliding and rocking action which because of the slit edge of the tape tears the taped tray clear of the tape 44.

The tray covered and sealed with a tape section 44*a* is shown in FIG. 1*a*. Usually as shown there may be short extensions of tape 51, 52 at the front and rear edges of the tray, and these are merely folded down and pressed tight against the front and rear sides of the tray to provide a neat appearance as well as to help anchor the tape on the tray.

The tape is preferably transparent, so that if desirable, as where a reaction is taking place, the material in the wells may be viewed directly or by placing the sealed tray in a suitable reader device. The sealed tray may be conveyed to the reader or any other device or stored without danger of losing the contents of the wells.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A device for applying a cover over the surface of a test tray having a multiplicity of upwardly open wells, comprising a base having a sealing zone intermediate a tray loading zone and a tray removal zone, means rotatably mounting a roll of tape in the upper part of said sealing zone, slide guide means on said loading zone leading to said sealing zone, feed means in said sealing zone for applying the leading end of said tape upon and along the top surface of said tray while moving said tray along said slide guide means to said removal zone comprising a rotatable feed roller disposed for pressing the leading end of said tape onto the top surface of said moving tray, and a tape guide pin or roller mounted on a fixed axis below said tape roll at the loading zone side of said sealing zone for tensioning the tape from said roll and directing the leading end of said tape at a predetermined angle to the underside of said feed roller while affixing the tape thereto, rotation of said roller serving to draw tape from said roll over said guide pin or roller and to slidably displace said tray through said sealing zone, and means movably mounted at said base for holding the leading end of the tape against said roller, said holding means being positioned so as to be engaged by the tray and moved to inoperative position when the tray passes through said sealing zone.

2. The device defined in claim 1, wherein said feed roller has a deformable peripheral surface.

3. The device defined in claim 1, wherein said tape is pressure sensitive and is threaded under said roller with the non-stickly surface engaging said roller and the sticky surface facing the path of said tray.

4. The device defined in claim 1, wherein said holding means is a pivoted member spring biased to urge the tape against said roller.

5. The device defined in claim 1, wherein cutting means is mounted above said base and is operable for slitting the tape at the trailing end of the tray after the tray has passed to the removal zone.

6. The device defined in claim 1, wherein the removal zone has a platform at the same level as said slide guide means for slidably receiving said covered tray and an abutment for stopping tray movement after the top surface of the tray has been covered by said tape.

7. The device defined in claim 1, wherein a pair of arms extend upright from the base at said sealing zone and are formed with said means for rotatably mounting a supply roll of said tape, a said feed roller is rotatably mounted on said arms below said supply roll.

* * * * *